US007798466B2

(12) United States Patent
Springett et al.

(10) Patent No.: US 7,798,466 B2
(45) Date of Patent: Sep. 21, 2010

(54) RAM LOCKING BLOWOUT PREVENTER

(75) Inventors: Frank Benjamin Springett, Houston, TX (US); James William Weir, Houston, TX (US)

(73) Assignee: Varco I/P, Inc., Houston, TX (US)

( * ) Notice: Subject to any disclaimer, the term of this patent is extended or adjusted under 35 U.S.C. 154(b) by 816 days.

(21) Appl. No.: 11/796,547

(22) Filed: Apr. 27, 2007

(65) Prior Publication Data

US 2008/0265188 A1 Oct. 30, 2008

(51) Int. Cl.
*E21B 33/06* (2006.01)

(52) U.S. Cl. ..... 251/1.3; 251/95; 251/285; 166/85.4

(58) Field of Classification Search ..... 251/1.3, 251/1.2, 1.1, 284, 285, 90, 92, 93; 166/85.4
See application file for complete search history.

(56) References Cited

U.S. PATENT DOCUMENTS

| | | | | |
|---|---|---|---|---|
| 3,242,826 A | | 3/1966 | Smith | 92/24 |
| 3,272,222 A | * | 9/1966 | Allen | 251/1.3 |
| 3,670,761 A | | 6/1972 | Lerouax | 137/315 |
| 3,791,616 A | | 2/1974 | LeRouax | 251/1 |
| 3,871,613 A | | 3/1975 | LeRouax | 251/1 |
| 3,918,478 A | | 11/1975 | LeRouax | 137/315 |
| 3,941,141 A | | 3/1976 | Robert | 137/1 |
| 3,946,806 A | | 3/1976 | Meynier, III | 166/55 |
| 4,052,995 A | | 10/1977 | Ellison | 137/1 |
| 4,076,208 A | | 2/1978 | Olson | 251/1 A |
| 4,188,860 A | | 2/1980 | Miller | 92/15 |
| 4,253,638 A | | 3/1981 | Troxell, Jr. | 251/1 |
| 4,290,577 A | | 9/1981 | Olson | 251/1 A |

(Continued)

FOREIGN PATENT DOCUMENTS

DE 3 317 487 11/1984

(Continued)

OTHER PUBLICATIONS

Land and Marine Drilling. U Blowout Preventer Wedgelocks. Cameron Iron Works. 1 p. & Cover Page. May 1982.

(Continued)

*Primary Examiner*—John K Fristoe, Jr.
*Assistant Examiner*—Andrew J Rost
(74) *Attorney, Agent, or Firm*—Williams, Morgan & Amerson, P.C.

(57) ABSTRACT

A blowout preventer including, in certain aspects, a main body, a bonnet movably connected to the main body, the bonnet having a bonnet channel with interior threading, a ram shaft with a first portion extending through the main body and a second portion extending through the bonnet, the ram shaft having a ram shaft channel therein and an outer end, a ram connected to the ram shaft for selectively engaging a pipe, a locking assembly for selectively locking the ram shaft, the locking assembly including a torquing shaft with a portion within the ram shaft channel, the torquing shaft having an external end projecting beyond the bonnet, a locking shaft secured to the torquing shaft, the locking shaft having exterior threading for threadedly engaging the interior threading of the bonnet channel, and the locking shaft rotatable within the bonnet channel to abut the outer end of the ram shaft to releasably lock the ram shaft in position.

14 Claims, 7 Drawing Sheets

U.S. PATENT DOCUMENTS

| | | | | | |
|---|---|---|---|---|---|
| 4,305,565 | A | | 12/1981 | Abbe | 251/1 A |
| 4,437,643 | A | * | 3/1984 | Brakhage et al. | 251/1.3 |
| 4,438,900 | A | | 3/1984 | Schaeper et al. | 251/18 |
| 4,456,215 | A | * | 6/1984 | Bishop et al. | 251/1.2 |
| 4,492,359 | A | * | 1/1985 | Baugh | 251/1.3 |
| 4,502,534 | A | | 3/1985 | Roche et al. | 166/84 |
| 4,504,037 | A | | 3/1985 | Beam et al. | 251/1 A |
| 4,519,577 | A | | 5/1985 | Jones | 251/62 |
| 4,558,842 | A | | 12/1985 | Peil et al. | 251/1.3 |
| 4,582,293 | A | | 4/1986 | Jones | 251/1.3 |
| 4,601,232 | A | | 7/1986 | Troxell, Jr. | 92/24 |
| 4,877,217 | A | | 10/1989 | Peil et al. | 251/1.3 |
| 4,969,390 | A | | 11/1990 | Williams, II | 92/28 |
| 4,969,627 | A | | 11/1990 | Williams, II | 251/1.3 |
| 5,025,708 | A | | 6/1991 | Smith et al. | 92/19 |
| 5,056,418 | A | | 10/1991 | Granger et al. | 92/24 |
| 5,063,828 | A | | 11/1991 | Kamimura et al. | 92/26 |
| 5,199,683 | A | | 4/1993 | Le | 251/1.3 |
| 5,217,073 | A | | 6/1993 | Bruns | 166/298 |
| 5,255,890 | A | | 10/1993 | Morrill | 251/1.3 |
| 5,400,857 | A | | 3/1995 | Whitby et al. | 166/297 |
| 5,505,426 | A | | 4/1996 | Whitby et al. | 251/1.3 |
| 5,515,916 | A | | 5/1996 | Haley | 166/55 |
| 5,575,452 | A | | 11/1996 | Whitby et al. | 251/1.3 |
| 5,653,418 | A | | 8/1997 | Olson | 251/1.3 |
| 5,662,171 | A | | 9/1997 | Brugman et al. | 166/383 |
| 5,735,502 | A | | 4/1998 | Levett et al. | 251/1.3 |
| 5,897,094 | A | | 4/1999 | Brugman et al. | 251/1.3 |
| 5,918,851 | A | | 7/1999 | Whitby | 251/1.3 |
| 6,173,770 | B1 | | 1/2001 | Morrill | 166/85.4 |
| 6,374,925 | B1 | | 4/2002 | Elkins et al. | 175/25 |
| 6,510,897 | B2 | | 1/2003 | Hemphill | 166/373 |
| 6,554,247 | B2 | | 4/2003 | Berckenhoff et al. | 251/1.3 |
| 6,782,799 | B2 | | 8/2004 | Vincent | 92/24 |
| 6,857,634 | B2 | | 2/2005 | Araujo | 277/325 |
| 7,051,989 | B2 | | 5/2006 | Springett et al. | 251/1.1 |
| 7,051,990 | B2 | | 5/2006 | Springett et al. | 251/1.1 |
| 7,195,224 | B2 | | 3/2007 | Le | 251/1.3 |
| 7,243,713 | B2 | | 7/2007 | Isaacks et al. | 166/85.4 |
| 7,246,666 | B2 | | 7/2007 | Hemphill et al. | 166/373 |
| 7,331,562 | B2 | | 2/2008 | Springett | 251/1.3 |
| 2004/0021269 | A1 | | 2/2004 | Gaudette et al. | 277/325 |
| 2004/0084644 | A1 | | 5/2004 | Wiedemann | 251/1.3 |
| 2004/0222393 | A1 | | 11/2004 | Kinder | 251/1.3 |

FOREIGN PATENT DOCUMENTS

| | | |
|---|---|---|
| GB | 1 352 258 | 5/1974 |
| GB | 1352260 | 5/1974 |
| GB | 2100773 A | 1/1983 |
| GB | 2 154 265 | 9/1985 |

OTHER PUBLICATIONS

Ultralock II Automatic Locking System. Shaffer A Varco Company, 2 pp. . 2002.

* cited by examiner

RAM LOCKING BLOWOUT PREVENTER

BACKGROUND OF THE INVENTION

1. Field of the Invention

The present invention is directed to; high pressure containment apparatuses; blowout preventers; to ram locking mechanisms for them; and to methods of their use.

2. Description of Related Art

In a variety of situations, blowout preventers are used to control sub-surface pressures that may adversely affect equipment used in drilling oil and gas wells. Manual mechanisms and pneumatic or hydraulic pressure are employed to act on a piston to close or open ram sealing elements. Often hydraulic actuation is used since the required closing forces are relatively high. Hydraulic actuation force is applied to a cylinder containing a piston which in turn acts on a shaft having a ram element connected thereto. In certain prior art blowout preventer systems, a ram locking member is operable by turning an exterior shaft extension projecting from the blowout preventer. Alternatively the locking member is movable automatically, e.g. using known automatic operator apparatus, e.g., but not limited to known POSLOCK™ apparatus available from National Oilwell Varco, owner of the present invention.

U.S. Pat. No. 5,575,452 co-owned with the present invention, discloses, inter alia, a blowout preventer ram actuator mechanism with a primary piston including an outer sleeve portion which supports an independently movable locking piston which has tapered surfaces, and locking segments each engage one of a plurality of tapered locking rods fixed to the actuating mechanism housing. U.S. Pat. No. 7,195,224, co-owned with the present invention, discloses, inter alia, blowout preventers having a main body, a ram system with ram apparatus, a movement system with movable shaft apparatus connected to the ram apparatus, the ram apparatus movable from a first open-ram position to a second closed-ram position, the movable shaft apparatus including a locking shaft portion having a tapered portion, a locking system for selectively locking the ram apparatus in the closed position and having locking member apparatus having a primary tapered surface in contact with the locking shaft portion which is movable with the so that the primary tapered surface contacts the tapered portion of the locking shaft portion to releasably lock the movable shaft apparatus.

In many prior ram-type blowout preventer systems, once rams have been moved to contact a tubular, e.g. a pipe, the rams are locked in place by turning a lock shaft connected to a ram shaft to which a ram is connected. Rotating the lock shaft sufficiently to lock a ram in position can often take a relatively long time.

Various prior blowout preventers have a main body with a projecting member or operating/cylinder "head" through which the lock shaft extends. External threading on the lock shaft threadedly engages internal threading on the head. Rotation of the lock shaft with respect to the head locks the ram shaft and the ram in a desired position preventing the ram from disengaging from a pipe. The head adds size and weight to the overall system and, in some cases, enlarges the distance that a lock shaft must travel to lock a ram in place. The head is designed to be sufficiently large and massive to handle the locking load, the load imposed on the ram shaft and the lock shaft by force acting on the rams pushing them out of engagement with a pipe (force from wellbore pressure active on a ram shaft or rubber pressure forcing the rams apart).

In certain prior blowout preventers in order to move a ram out of engagement with a tubular and open a bonnet or door, the bonnet must move the length of the ram plus the length of the stroke of a ram operator. In certain prior blowout preventers separate hydraulic circuits are used for ram movement and for bonnet movement.

BRIEF SUMMARY OF THE INVENTION

The present invention, in certain aspects, discloses a blowout preventer with a bonnet or a door with a threaded interior channel through which, initially, passes a portion of a ram shaft to which a blowout preventer ram is secured. An end of the ram shaft which initially projects beyond the interior threading of the door has a channel in which is disposed a torquing shaft of a locking assembly according to the present invention. The locking assembly includes a locking shaft and spring apparatus around the torquing shaft (any suitable spring or springs, including, but not limited to coil spring(s), wave springs, and/or belleville washer springs) which continuously biases the locking shaft toward the interior threading of the channel in the door. The locking shaft is rotatable with respect to this interior threading.

In operation as the ram shaft moves to move the ram to engage a pipe, the locking assembly moves with the ram shaft until the locking assembly contacts threads on the interior channel of the bonnet, then the ram shaft moves while the locking assembly remains in place, with the spring apparatus compressing, and biasing the locking shaft inwardly and maintaining it in correct alignment with the interior threading of the door channel.

Once the ram has engaged a pipe, the locking assembly is rotated with the locking shaft threadedly engaging and moving inward with respect to the interior threading of the door channel and towards the outer end of the ram shaft. The locking assembly is rotated so that the locking shaft contacts the outer end of the ram shaft, locking the ram shaft and ram in position with the ram engaging the pipe or with the pipe severed.

Instead of moving the relatively long distance through a head and through a main blowout preventer body to lock a ram in place, the locking shaft of a locking assembly according to the present invention moves a relatively shorter distance along the interior channel of the door, to a final position abutting the outer end of the ram shaft. As described in detail below in certain aspects in a blowout preventer according to the present invention a bonnet is opened and closed using ram open pressure to gain access to a ram block. Thus the bonnet only needs to open far enough to clear the ram block, i.e., the length of the ram block. To open the bonnet with the ram already off of a tubular, disengaged, the bonnet needs to move only the length of the ram block—it needs only to open a distance equal to the length of the ram block—to expose the ram block with the bonnet open.

The present invention discloses, in certain aspects, a blowout preventer with a main body, a ram apparatus movable within the main body to engage a tubular, hydraulic circuit apparatus for providing fluid under pressure to operate the ram apparatus, a bonnet movably connected to the main body for providing access to the ram apparatus, the bonnet movable by fluid under pressure supplied by the hydraulic circuit apparatus, bonnet movement apparatus, the bonnet movement apparatus in fluid communication with the hydraulic circuit apparatus, the hydraulic circuit apparatus including valve apparatus, the valve apparatus selectively controlling flow of fluid under pressure to the bonnet movement apparatus to move the bonnet with respect to the body, and valve activation apparatus for manually activating the valve apparatus to open or close the bonnet.

The present invention discloses, in certain aspects, a blowout preventer with a main body, a ram apparatus movable within the main body to engage a tubular, hydraulic circuit apparatus for providing fluid under pressure to operate the ram apparatus, a bonnet movably connected to the main body for providing access to the ram apparatus, bonnet movement apparatus, the bonnet movable by fluid under pressure supplied to the bonnet movement apparatus, the hydraulic circuit apparatus including valve apparatus, the valve apparatus selectively controlling flow of fluid under pressure to the bonnet movement apparatus to move the bonnet with respect to the body, and valve activation apparatus for manually activating the valve apparatus to open or close the bonnet.

The present invention discloses, in certain aspects, a blowout preventer with a main body, a bonnet movably connected to the main body, the bonnet having a bonnet channel with interior threading, a ram shaft with a first portion extending through the main body and a second portion extending through the bonnet, the ram shaft having abram shaft channel therein and an outer end, a locking assembly for selectively locking the ram shaft, the locking assembly including a locking member having exterior threading for threadedly engaging the interior threading of the bonnet channel, and the locking member rotatable within the bonnet channel so that the locking member abuts the outer end of the ram shaft to releasably lock the ram shaft in position.

The present invention discloses, in certain aspects, methods for releasably locking a ram shaft of a blowout preventer, the blowout preventer as any described herein with a ram, ram shaft, and a locking assembly with a locking member, the method including moving the ram and the ram shaft to a terminal position, moving the locking member to an entrance to a bonnet channel of a bonnet, threadedly engaging exterior threading of the locking member with interior threading of the bonnet channel, and rotating the locking member to abut the outer end of the ram shaft to releasably lock the ram shaft in position.

Accordingly, the present invention includes features and advantages which are believed to enable it to advance blowout preventer ram locking technology. Characteristics and advantages of the present invention described above and additional features and benefits will be readily apparent to those skilled in the art upon consideration of the following detailed description of preferred embodiments and referring to the accompanying drawings.

Certain embodiments of this invention are not limited to any particular individual feature disclosed here, but include combinations of them distinguished from the prior art in their structures, functions, and/or results achieved. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

What follows are some of, but not all, the objects of this invention. In addition to the specific objects stated below for at least certain embodiments of the invention, there are other objects and purposes which will be readily apparent to one of skill in this art who has the benefit of this invention's teachings and disclosures. It is, therefore, an object of at least certain preferred embodiments of the present invention to provide:

New, useful, unique, efficient, non-obvious blowout preventers, ram locking mechanisms for blowout preventers, and methods of their use.

The present invention recognizes and addresses the problems and needs in this area and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of certain preferred embodiments, given for the purpose of disclosure, when taken in conjunction with the accompanying drawings. The detail in these descriptions is not intended to thwart this patent's object to claim this invention no matter how others may later attempt to disguise it by variations in form, changes, or additions of further improvements.

The Abstract that is part hereof is to enable the U.S. Patent and Trademark Office and the public generally, and scientists, engineers, researchers, and practitioners in the art who are not familiar with patent terms or legal terms of phraseology to determine quickly from a cursory inspection or review the nature and general area of the disclosure of this invention. The Abstract is neither intended to define the invention, which is done by the claims, nor is it intended to be limiting of the scope of the invention in any way.

It will be understood that the various embodiments of the present invention may include one, some, or all of the disclosed, described, and/or enumerated improvements and/or technical advantages and/or elements in claims to this invention.

BRIEF DESCRIPTION OF THE SEVERAL VIEWS OF THE DRAWING

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

Figure 1:
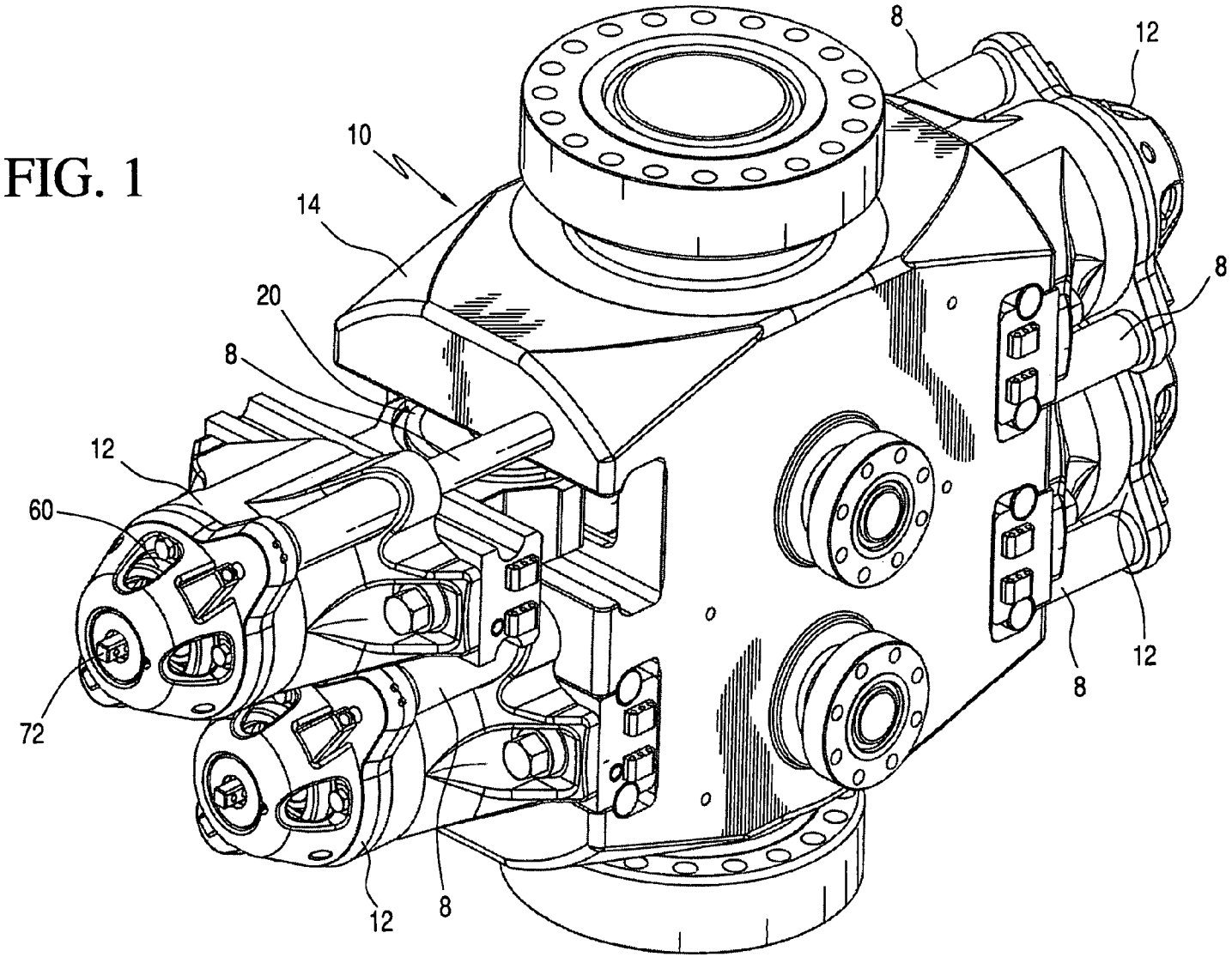
FIG. 1 is a perspective view of a blowout preventer according to the present invention.

Presently preferred embodiments of the invention are shown in the above-identified figures and described in detail below. Various aspects and features of embodiments of the invention are described below and some are set out in the dependent claims. Any combination of aspects and/or features described below or shown in the dependent claims can be used except where such aspects and/or features are mutually exclusive. It should be understood that the appended drawings and description herein are of preferred embodiments and are not intended to limit the invention or the appended claims. On the contrary, the intention is to cover all modifications, equivalents and alternatives falling within the spirit and scope of the invention as defined by the appended claims. In showing and describing the preferred embodiments, like or identical reference numerals are used to identify common or similar elements. The figures are not necessarily to scale and certain features and certain views of the figures may be shown exaggerated in scale or in schematic in the interest of clarity and conciseness.

As used herein and throughout all the various portions (and headings) of this patent, the terms "invention", "present invention" and variations thereof mean one or more embodiments, and are not intended to mean the claimed invention of any particular appended claim(s) or all of the appended claims. Accordingly, the subject or topic of each such reference is not automatically or necessarily part of, or required by, any particular claim(s) merely because of such reference.

DETAILED DESCRIPTION OF THE INVENTION

Figure 2:
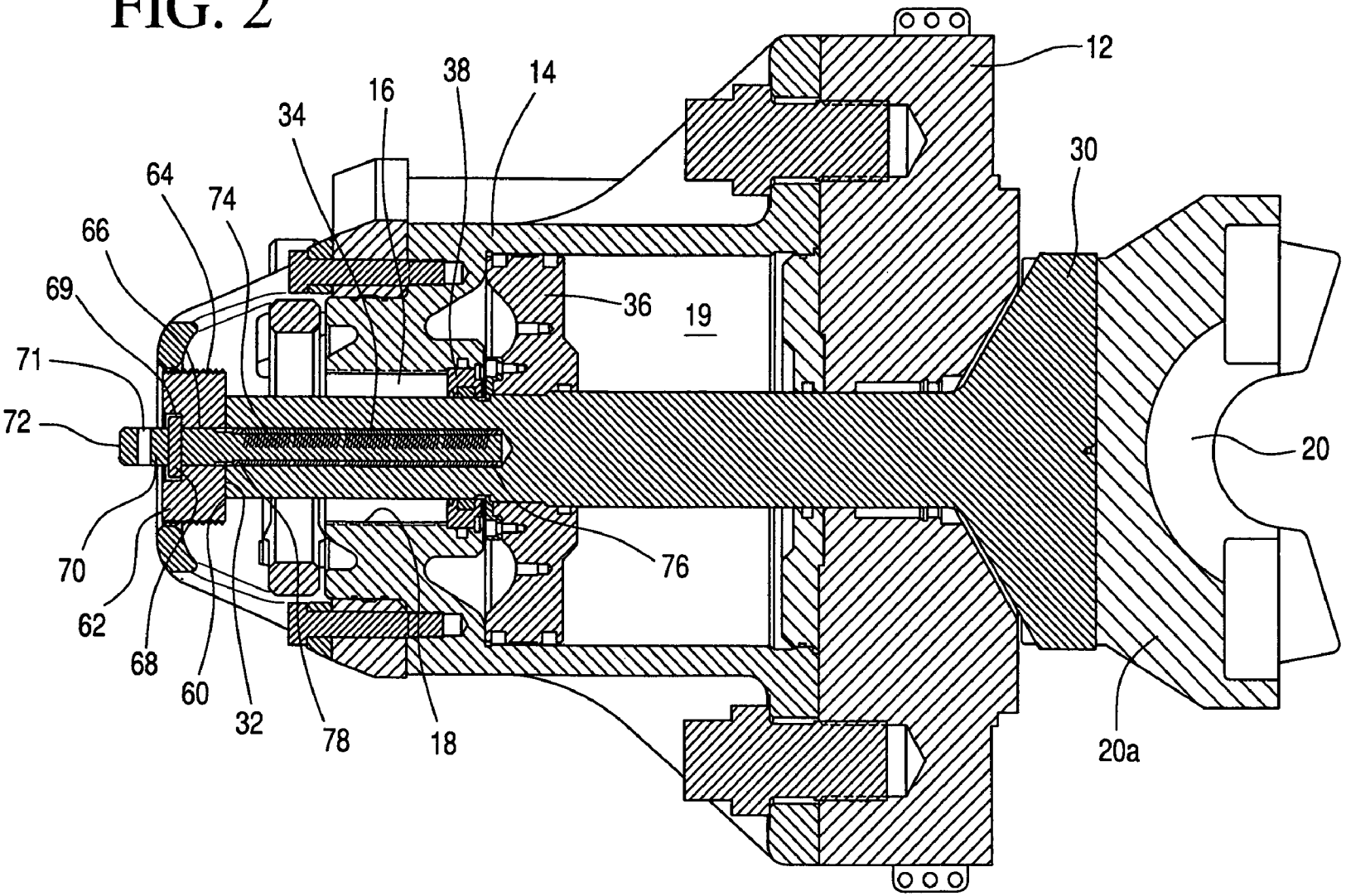
FIG. 2 is a cross-section view of the part of the blowout preventer of FIG. 1.

FIG. 1 shows a blowout preventer 10 according to the present invention with movable bonnets 12 each movable with respect to a main body 14. A ram 20 on a ram shaft 30 (see FIGS. 1 and 2) projects from each bonnet 12. An outer end 72 of a torquing shaft 70 of a locking assembly 60 according to the present invention is outside each bonnet 12.

A piston 36 connected to the ram shaft 30 moves within a chamber 19 to move the ram shaft 30 so that the ram 20 can engage a tubular. Power fluid enters the chamber 19 via an inlet and exits via an outlet (see FIG. 6).

Part of the torquing shaft 70 is disposed within a channel 34 in the ram shaft 30. Springs 74 abut a stop 76 at one end of the torquing shaft 70 and a stop 78 at another location on the torquing shaft 70 to bias a locking shaft 62 inwardly and to maintain alignment of threads 64 on the exterior of the locking shaft 62 and interior threads 18 of a channel 16 in the bonnet 12. The torquing shaft 70 is secured to the locking shaft 62. A pin 68 in a recess 69 of the locking shaft 62 maintains the position of the locking shaft 62. A seal gland 38 encompassing the ram shaft 30 seals across the channel 16.

A portion of the torquing shaft 70 extends out through a channel 66 in the locking shaft 62. A hole 71 through the torquing shaft 70 provides a location for a tool, e.g. a handwheel used to manually rotate the locking assembly 60.

Figure 3:
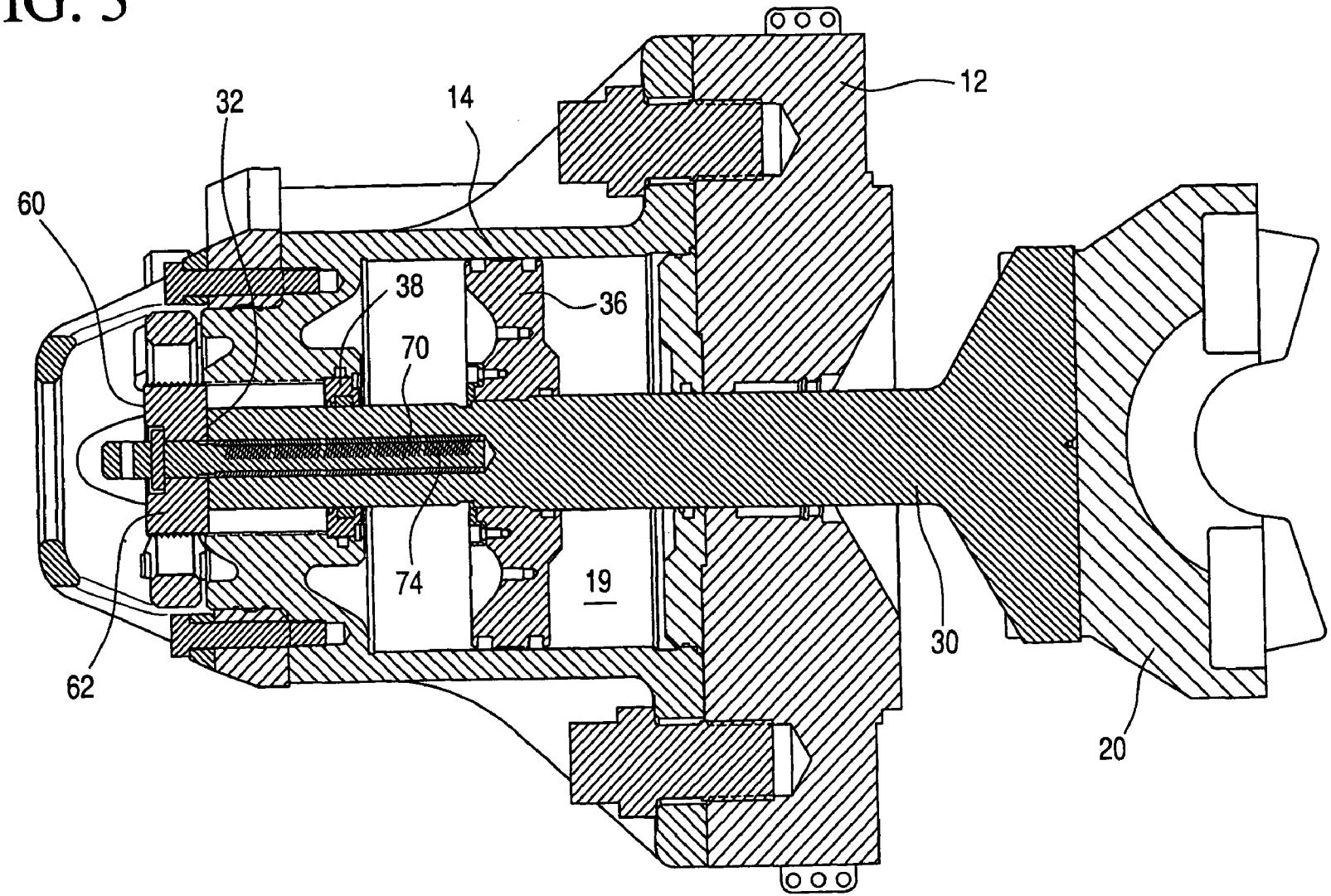
FIG. 3 is a cross-section view of the part of the blowout preventer shown in FIG. 1 showing a step in a method of its operation.
Figure 4:
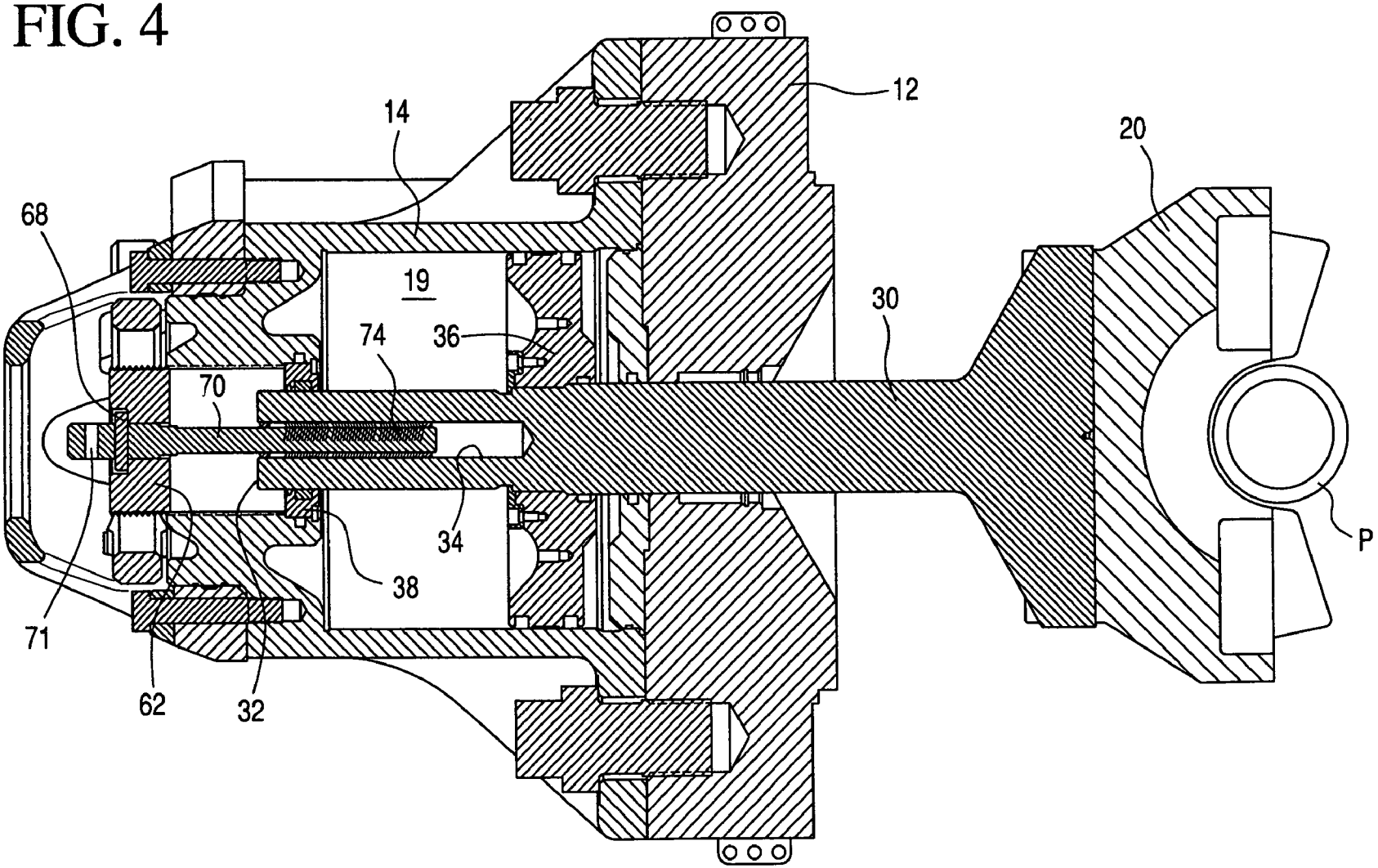
FIG. 4 is a cross-section view of the blowout preventer of FIG. 1 showing a step in a method of its operation.

As shown in FIG. 3, an operator device, not shown, has been activated to move the ram 20 to engage a pipe P. The ram 20, ram shaft 30, piston 36, and locking assembly 60 have moved (to the right in FIG. 3). The locking shaft 62 has moved to the entrance to the channel 16. FIG. 4 shows the ram shaft 30 moved with respect to the torquing shaft 70 with the springs 74 compressed. The ram 20 has contacted/engaged the pipe P.

Figure 5:
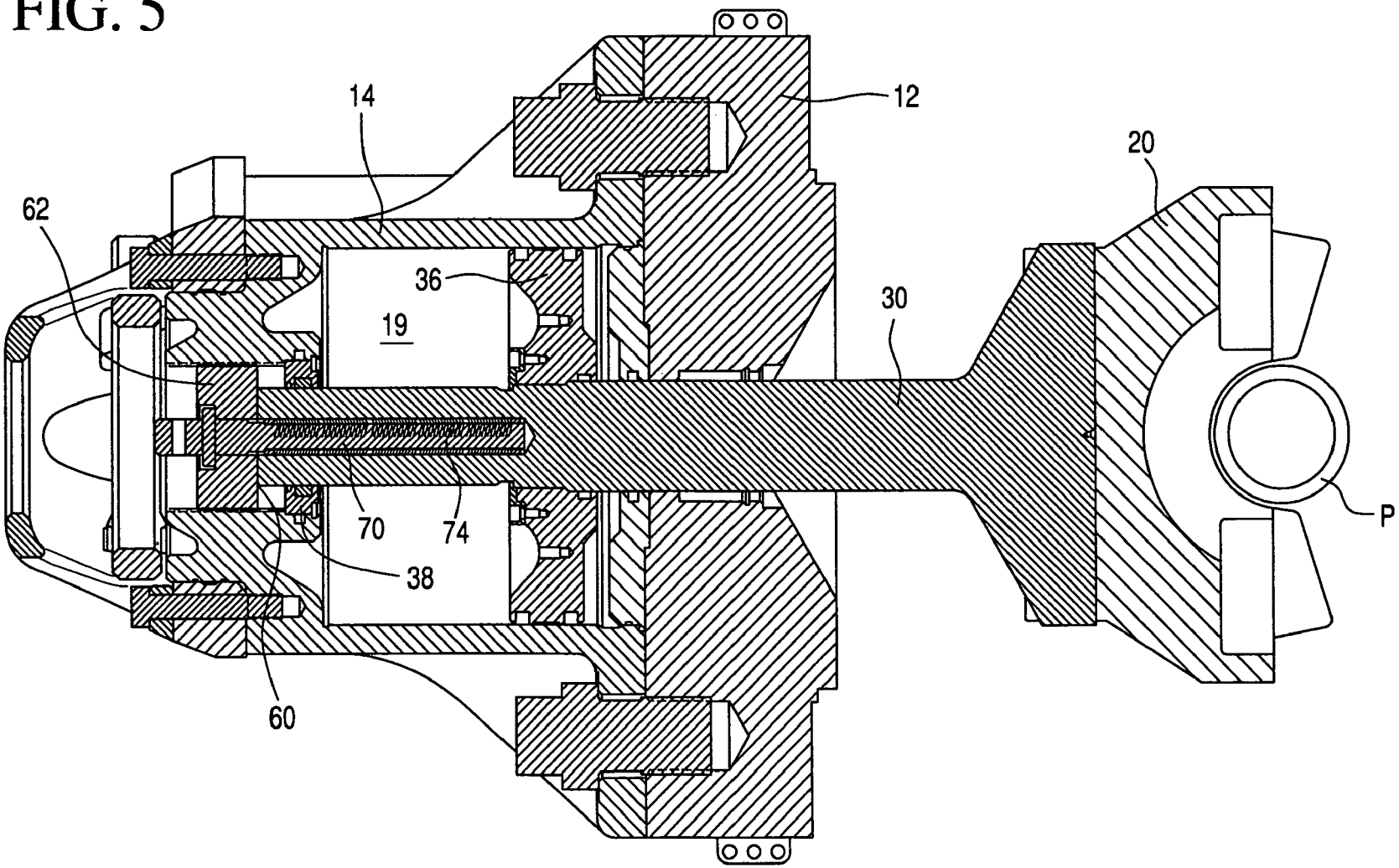
FIG. 5 is a cross-section view of the blowout preventer of FIG. 1 showing a step in a method of its operation.

To lock the ram shaft 30 in place, the torquing shaft 70 is rotated to move the locking shaft 62 to abut the end 32 of the ram shaft 30 (as shown in FIG. 5). The locking shaft 62 moves the distance from the entrance to the channel 16 to the end 32 of the ram 30 to achieve the releasable lock of the ram shaft 30.

Figure 6:
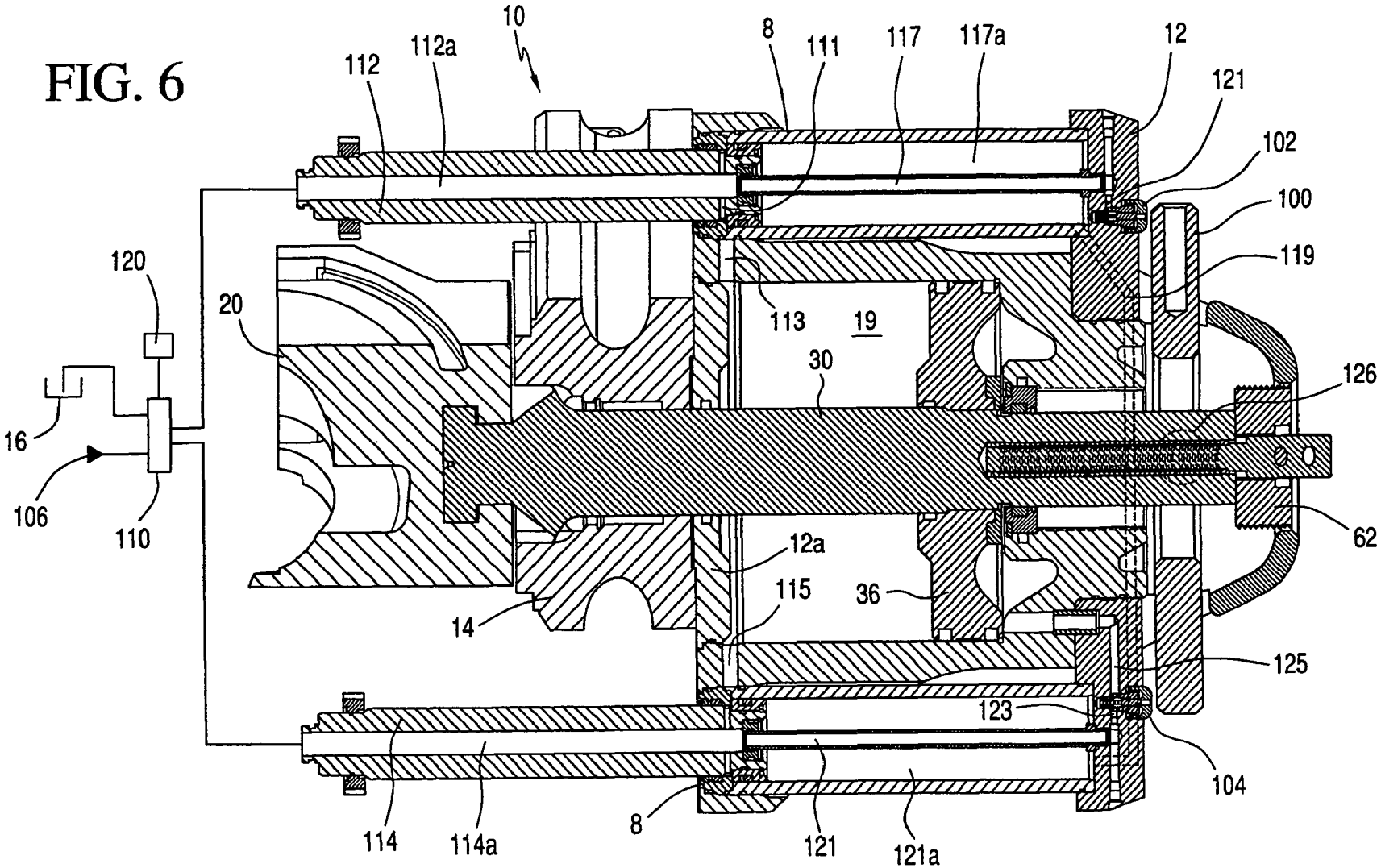
FIG. 6 is a cross-section view partially in schematic form of part of the system of FIG. 1 (with bonnet open).

FIG. 6 illustrates a system for moving a bonnet 12 of the system 10 to open and close the bonnet 12 with respect to the main body 14. As shown in FIGS. 1 and 6, the system 10 includes an optional rocker plate 100 which is used to contact and manually activate a valve 102 or 104 to open (activate valve 102) or close (activate valve 104) the bonnet 12. It is within the scope of the present invention to use any suitable known structure or apparatus to manually activate the valves 102, 104, including, but not limited to, handwheels, wrenches, and/or levers (levers on the valves, levers adjacent the valves).

A control valve 110 (e.g. a typical 3-way directional control valve) controls the flow of fluid under pressure from a fluid source 106 to a ram-open piston 112 with a channel 112*a* and to a ram-close piston 114 with a channel 114*a*. A control system 120 controls the valve 110. Vented fluid flows to tank 116.

As shown in FIG. 6, the ram 20 is not in contact with a pipe; the bonnet 12 is open; the piston 36 has had fluid applied to it to move the bonnet 12 open; and fluid is applied to the pistons 112 and 114. The fluid flowed from the source 106; through the valve 110; to and through the channel 112*a*; to and through a channel 111; to and through a channel 113; and into the chamber 19 to pressurize the piston 36. This fluid flows from a channel 117 to the valve 102. The valve 102 is shut so that the system is maintained in a bonnet-open position (unless activated by the rocker plate 100).

The rocker plate 100 moves in see-saw fashion on a fulcrum member 126. Depressed one way, the rocker plate 100 contacts and activates the valve 104 to vent fluid that is holding the bonnet 12 open, permitting the bonnet 12 to be closed.

Figure 7:
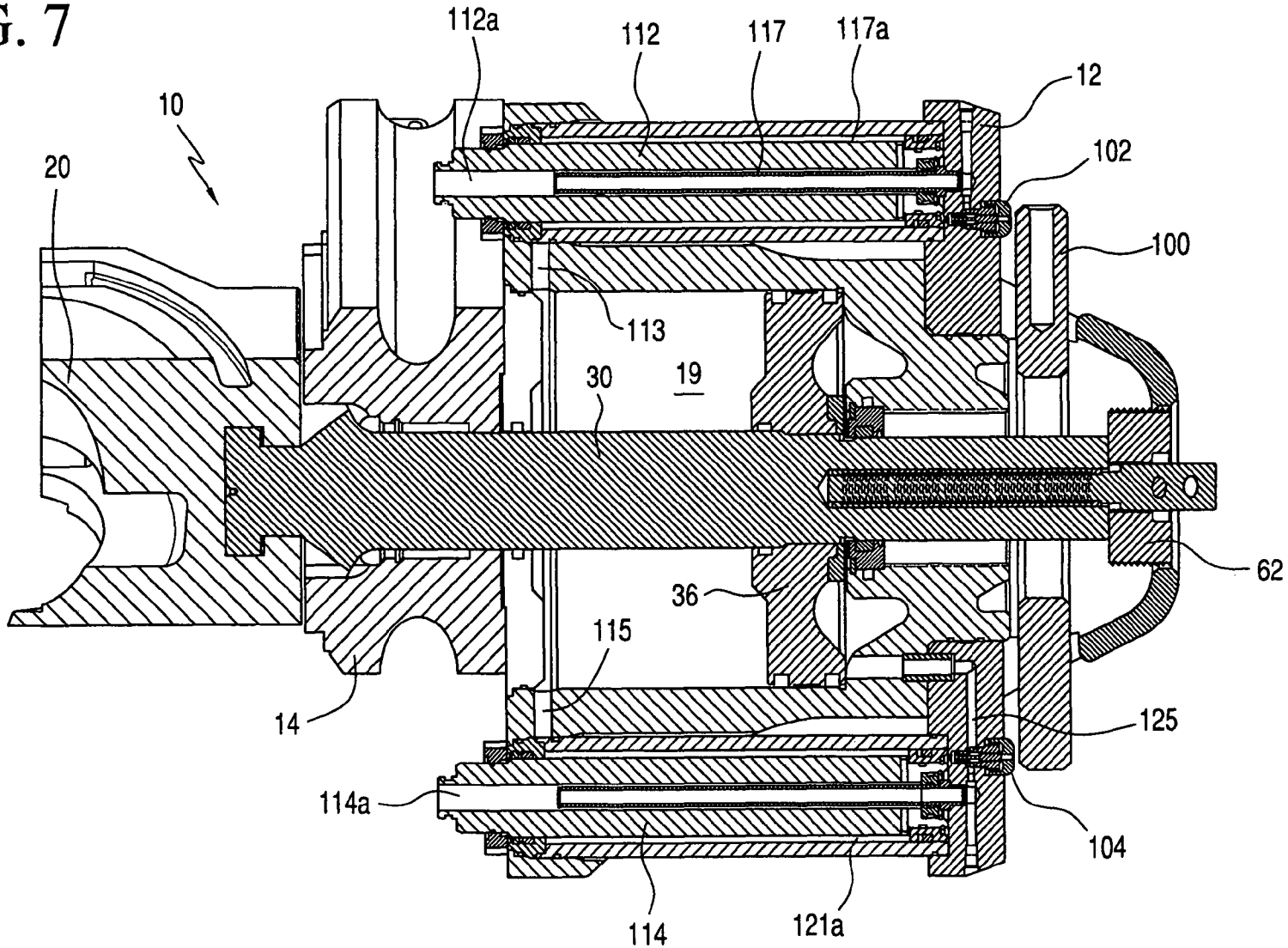
FIG. 7 is a cross-section view partially in schematic form of part of the system of FIG. 1 (with bonnet closed).

Pushing the rocker plate against the valve 102 allows pressurized fluid from the chamber 19 into the chambers 117*a*, 121*a*, extending the pistons 112, 114 so that the bonnet 12 can be opened. FIG. 7 shows the bonnet 12 closed.

To close the bonnet 12 so that the ram 20 can be moved to contact a pipe, the valve 110 is shifted so that fluid from the channel 112 is vented to tank 116 and fluid from the source 106 is sent to and through the channel 114; to and through a channel 121; to and through a channel 123; past the valve 104; to and through a channel 125; and into the chamber 19 on the other side (the right side as viewed in FIG. 6 of the piston 36). This fluid moves the piston 36 towards a bonnet plate 12*a*, thereby moving the ram shaft 30 to move the ram 20 to contact a pipe.

In blowout preventers according to the present invention, e.g. as described above and shown in FIGS. 1-7, the fluid under pressure used for ram opening (moving a ram 20 away from a tubular) is also used to open and close the bonnet 12. The bonnet 12 needs to move (open) only a "bonnet distance"—a length sufficient to clear the ram 20 with respect to the body 14, e.g. the length of a ram block 20*a* (see FIG. 2) plus a small increment to provide access to the block.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to the step literally and/or to all equivalent elements or steps. The following claims are intended to cover the invention as broadly as legally possible in whatever form it may be utilized. The invention claimed herein is new and novel in accordance with 35 U.S.C. §102 and satisfies the conditions for patentability in §102. The invention claimed herein is not obvious in accordance with 35 U.S.C. §103 and satisfies the conditions for patentability in §103. This specification and the claims that follow are in accordance with all of the requirements of 35 U.S.C. §112. The inventors may rely on the Doctrine of Equivalents to determine and assess the scope of their invention and of the claims that follow as they may pertain to apparatus not materially departing from, but outside of, the literal scope of the invention. All patents and applications identified herein are incorporated fully herein for all purposes. What follows are some of the claims for some of the embodiments and aspects of the present invention, but these claims are not necessarily meant to be a complete listing of nor exhaustive of every possible aspect and embodiment of the invention.

The invention claimed is:

1. A blowout preventer comprising a main body, a ram apparatus movable within the main body to engage a tubular, hydraulic circuit apparatus for providing fluid under pressure to operate the ram apparatus, a bonnet movably connected to the main body for providing access to the ram apparatus, the bonnet movable by fluid under pressure supplied by the hydraulic circuit apparatus, bonnet movement apparatus, the bonnet movement apparatus in fluid communication with the hydraulic circuit apparatus, the hydraulic circuit apparatus including valve apparatus, the valve apparatus selectively controlling flow of fluid under pressure to the bonnet movement apparatus to move the bonnet with respect to the body, and valve activation apparatus for manually activating the valve apparatus to open or close the bonnet further comprising the hydraulic circuit apparatus providing fluid for disengaging the ram apparatus from a tubular, a portion of said fluid for said disengaging useful for moving the bonnet, and the valve apparatus including a first valve and a second valve, the valve activation apparatus comprising a fulcrum member on the bonnet, a rocker plate mounted for rocking movement on the fulcrum member, the rocker plate movable in a first direction to contact the first valve to open the bonnet, the rocker plate movable in a second direction to contact the second valve to close the bonnet.

2. The blowout preventer of claim 1 wherein the bonnet movement apparatus includes a first piston/cylinder apparatus for moving the bonnet, and a second piston cylinder apparatus for moving the bonnet, the second piston/cylinder apparatus spaced-apart from the first piston/cylinder apparatus.

3. The blowout preventer of claim 1 wherein the ram apparatus includes a ram block with tubular engaging structure, the ram block and the tubular engaging structure having a block length, the hydraulic circuit apparatus provides fluid under pressure to disengage the tubular engaging structure from a tubular and to move the ram block away from the tubular, the bonnet movable by the bonnet movement apparatus a bonnet distance from the main body to provide access to the ram block.

4. The blowout preventer of claim 1 further comprising the bonnet having a bonnet channel with interior threading, the ram apparatus including a ram shaft with a first portion extending through the main body and a second portion extending through the bonnet, the ram shaft having a ram shaft channel therein and an outer end, a locking assembly for selectively locking the ram shaft, the locking assembly including a torquing shaft, a portion of the torquing shaft within the ram shaft channel, the torquing shaft having an external end projecting beyond the bonnet, a locking shaft secured to the torquing shaft, the locking shaft having exterior threading for threadedly engaging the interior threading of the bonnet channel, and the locking shaft rotatable within the bonnet channel to abut the outer end of the ram shaft to releasably lock the ram shaft in position.

5. The blowout preventer of claim 4 further comprising a ram connected to the ram shaft for selectively engaging a pipe, and the locking shaft rotatable to releasably lock the ram in position upon the ram engaging the pipe.

6. The blowout preventer of claim 4 further comprising spring apparatus urging the torquing shaft toward the ram shaft, inwardly of the bonnet.

7. The blowout preventer of claim 6 further comprising the spring apparatus also biasing the locking shaft inwardly and maintaining alignment of the exterior threading on the locking shaft and the interior threading of the bonnet channel.

8. The blowout preventer of claim 4 further comprising a hole through the external end of the locking shaft for receipt of an item for manual rotation of the locking assembly for selectively locking and unlocking the ram shaft.

9. A blowout preventer comprising a main body, a ram apparatus movable within the main body to engage a tubular, hydraulic circuit apparatus for providing fluid under pressure to operate the ram apparatus, a bonnet movably connected to the main body for providing access to the ram apparatus, bonnet movement apparatus, the bonnet movable by fluid under pressure supplied to the bonnet movement apparatus, the hydraulic circuit apparatus including valve apparatus, the valve apparatus selectively controlling flow of fluid under pressure to the bonnet movement apparatus to move the bonnet with respect to the body, and valve activation apparatus for manually activating the valve apparatus to open or close the bonnet, the blowout preventer further comprising the valve apparatus including a first valve and a second valve, the valve activation apparatus comprising a fulcrum member on the bonnet, a rocker member mounted for rocking movement on the fulcrum member, the rocker member movable in a first direction to contact the first valve to open the bonnet, and the rocker member movable in a second direction to contact the second valve to close the bonnet.

10. The blowout preventer of claim 9 wherein the ram apparatus includes tubular engagement apparatus and wherein hydraulic fluid under pressure supplied for operation of the ram apparatus to disengage the tubular engagement apparatus is also used to open and close the bonnet.

11. A method for releasably locking a ram shaft of a blowout preventer, the blowout preventer comprising a main body, a ram apparatus movable within the main body to engage a tubular, hydraulic circuit apparatus for providing fluid under pressure to operate the ram apparatus, the blowout preventer including a main body, a bonnet movably connected to the main body, the bonnet having a bonnet channel with interior threading, a ram shaft with a first portion extending through the main body and a second portion extending through the bonnet, the ram shaft having a ram shaft channel therein and an outer end, a locking assembly for selectively locking the ram shaft, the locking assembly including a locking member having exterior threading for threadedly engaging the interior threading of the bonnet channel, and the locking member rotatable within the bonnet channel so that the locking member abuts the outer end of the ram shaft to releasably lock the ram shaft in position, a ram on the ram shaft, the method comprisingmoving the ram and the ram shaft to a terminal position, moving the locking member to an entrance to the bonnet channel, threadedly engaging the exterior threading of the locking member with the interior threading of the bonnet channel, and rotating the locking member to abut the outer end of the ram shaft to releasably lock the ram shaft in position, and wherein the locking assembly includes a torquing shaft, a portion of the torquing shaft movable within the ram shaft channel, the torquing shaft having an external end projecting beyond the bonnet, the locking member including a locking shaft secured to the torquing shaft, and the locking shaft rotatable within the bonnet channel to move with the torquing shaft, the torquing shaft movable in the ram shaft channel, and wherein the blowout preventer includes spring apparatus urging the torquing shaft toward the ram shaft, inwardly of the bonnet, the method further comprising urging the torquing shaft toward the ram shaft with the spring apparatus.

12. The method of claim 11 wherein the spring apparatus also biases the locking shaft inwardly and maintains alignment of the exterior threading on the locking shaft and the interior threading of the bonnet channel, the method further comprising biasing the locking shaft inwardly with the spring apparatus and maintaining alignment of the exterior threading on the locking shaft and the interior threading of the bonnet channel.

13. The method of claim 11 wherein the ram apparatus includes a ram block with tubular engaging structure, the ram block and the tubular engaging structure having a block length, the hydraulic circuit apparatus provides fluid under pressure to disengage the tubular engaging structure from a tubular and to move the ram block away from the tubular, the bonnet movable a distance no further than the block length away from the main body by the bonnet movement apparatus to provide access to the ram block, the method further comprising moving the bonnet only a distance equal to the block length to provide access to the ram block.

14. The method of claim 11 wherein the hydraulic circuit apparatus provides fluid for disengaging the ram apparatus from a tubular, a portion of said fluid for disengaging useful for moving the bonnet, the method further comprising moving the bonnet with said portion of said fluid for disengaging.

* * * * *